US006412740B1

(12) United States Patent
Rush et al.

(10) Patent No.: US 6,412,740 B1
(45) Date of Patent: Jul. 2, 2002

(54) ADJUSTABLE POT SUPPORTING DEVICE

(76) Inventors: Milagros Rush; Gary Rush, both of 905 Lakewood Dr., Barrington, IL (US) 60010

( * ) Notice: Subject to any disclaimer, the term of this patent is extended or adjusted under 35 U.S.C. 154(b) by 0 days.

(21) Appl. No.: 09/637,661

(22) Filed: Aug. 14, 2000

(51) Int. Cl.[7] ..... A47G 7/02

(52) U.S. Cl. ..... 248/312.1; 248/27.8; 248/312.1; 248/313; 248/315; 47/67; 47/44

(58) Field of Search ..... 47/68, 73, 40, 47/44, 67; 248/213.2, 312.1, 312, 313, 315, 316.1, 316.4, 316.5, 323, 27.8

(56) References Cited

U.S. PATENT DOCUMENTS 134,637 A * 1/1873 Brown ..... 248/97
1,740,364 A * 12/1929 Dal Maso ..... 248/331.31
1,793,072 A * 2/1931 Fanan ..... 294/31.2
2,492,152 A * 12/1949 Hollowell ..... 47/80
4,014,506 A * 3/1977 Hanson ..... 248/312.1
5,065,891 A * 11/1991 Casey ..... 220/495.08

* cited by examiner

*Primary Examiner*—Leslie A. Braun
*Assistant Examiner*—Steven M. Marsh
(74) *Attorney, Agent, or Firm*—Goldstein & Lavas, P.C.

(57) ABSTRACT

An adjustable pot supporting device including an adjustable circular band adapted for being positioned below the annular ridge of the small pot. A pair of adjustable brackets are secured to the adjustable circular band. The adjustable brackets are positionable on the upper end of the larger decorative pot to support the small pot within the larger decorative pot.

3 Claims, 3 Drawing Sheets

ADJUSTABLE POT SUPPORTING DEVICE

BACKGROUND OF THE INVENTION

The present invention relates to an adjustable pot supporting device and more particularly pertains to allowing a smaller potted plant to be supported inside a larger decorative pot.

The use of pot holders is known in the prior art. More specifically, pot holders heretofore devised and utilized for the purpose of holding potted plants are known to consist basically of familiar, expected and obvious structural configurations, notwithstanding the myriad of designs encompassed by the crowded prior art which have been developed for the fulfillment of countless objectives and requirements.

While these devices fulfill their respective, particular objective and requirements, these patents do not describe an adjustable pot supporting device for allowing a smaller potted plant to be supported inside a larger decorative pot.

In this respect, the adjustable pot supporting device according to the present invention substantially departs from the conventional concepts and designs of the prior art, and in doing so provides an apparatus primarily developed for the purpose of allowing a smaller potted plant to be supported inside a larger decorative pot.

Therefore, it can be appreciated that there exists a continuing need for a new and improved adjustable pot supporting device which can be used for allowing a smaller potted plant to be supported inside a larger decorative pot. In this regard, the present invention substantially fulfills this need.

SUMMARY OF THE INVENTION

In the view of the foregoing disadvantages inherent in the known types of pot holders now present in the prior art, the present invention provides an improved adjustable pot supporting device. As such, the general purpose of the present invention, which will be described subsequently in greater detail, is to provide a new and improved adjustable pot supporting device which has all the advantages of the prior art and none of the disadvantages.

To attain this, the present invention essentially comprises an adjustable circular band adapted for being positioned below the annular ridge of the small pot. The circular band is comprised of a pair of semi-circular segments each having opposed ends. The circular band includes a pair of braces for adjustably receiving the opposed ends of the semi-circular segments to form a circle. A pair of adjustable brackets are secured to the adjustable circular band. The adjustable brackets are diametrically opposed with respect to one another. Each of the adjustable brackets includes a base plate secured to one of the semi-circular segments. The adjustable brackets include a pair of receiving collars secured to the base plate. The receiving collars each have open outer ends. The adjustable brackets include a pair of lower horizontal segments adjustably received within the open outer ends of the receiving collars. The adjustable brackets include a pair of intermediate angularly disposed segments extending outwardly from the lower horizontal segments. The adjustable brackets include a pair of upper horizontal segments extending outwardly from the intermediate angularly disposed segments. The upper horizontal segments are positioned on the upper end of the larger decorative pot.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adjustable pot supporting device which has all the advantages of the prior art pot holders and none of the disadvantages.

It is another object of the present invention to provide a new and improved adjustable pot supporting device which may be easily and efficiently manufactured and marketed.

It is a further object of the present invention to provide a new and improved adjustable pot supporting device which is of durable and reliable construction.

An even further object of the present invention is to provide a new and improved adjustable pot supporting device which is susceptible of a low cost of manufacture with regard to both materials and labor, and which accordingly is then susceptible of low prices of sale to the consuming public, thereby making such an adjustable pot supporting device economically available to the buying public.

Even still another object of the present invention is to provide a new and improved adjustable pot supporting device for allowing a smaller potted plant to be supported inside a larger decorative pot.

Lastly, it is an object of the present invention to provide a new and improved adjustable pot supporting device including an adjustable circular band adapted for being positioned below the annular ridge of the small pot. A pair of adjustable brackets are secured to the adjustable circular band. The adjustable brackets are positionable on the upper end of the larger decorative pot to support the small pot within the larger decorative pot.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
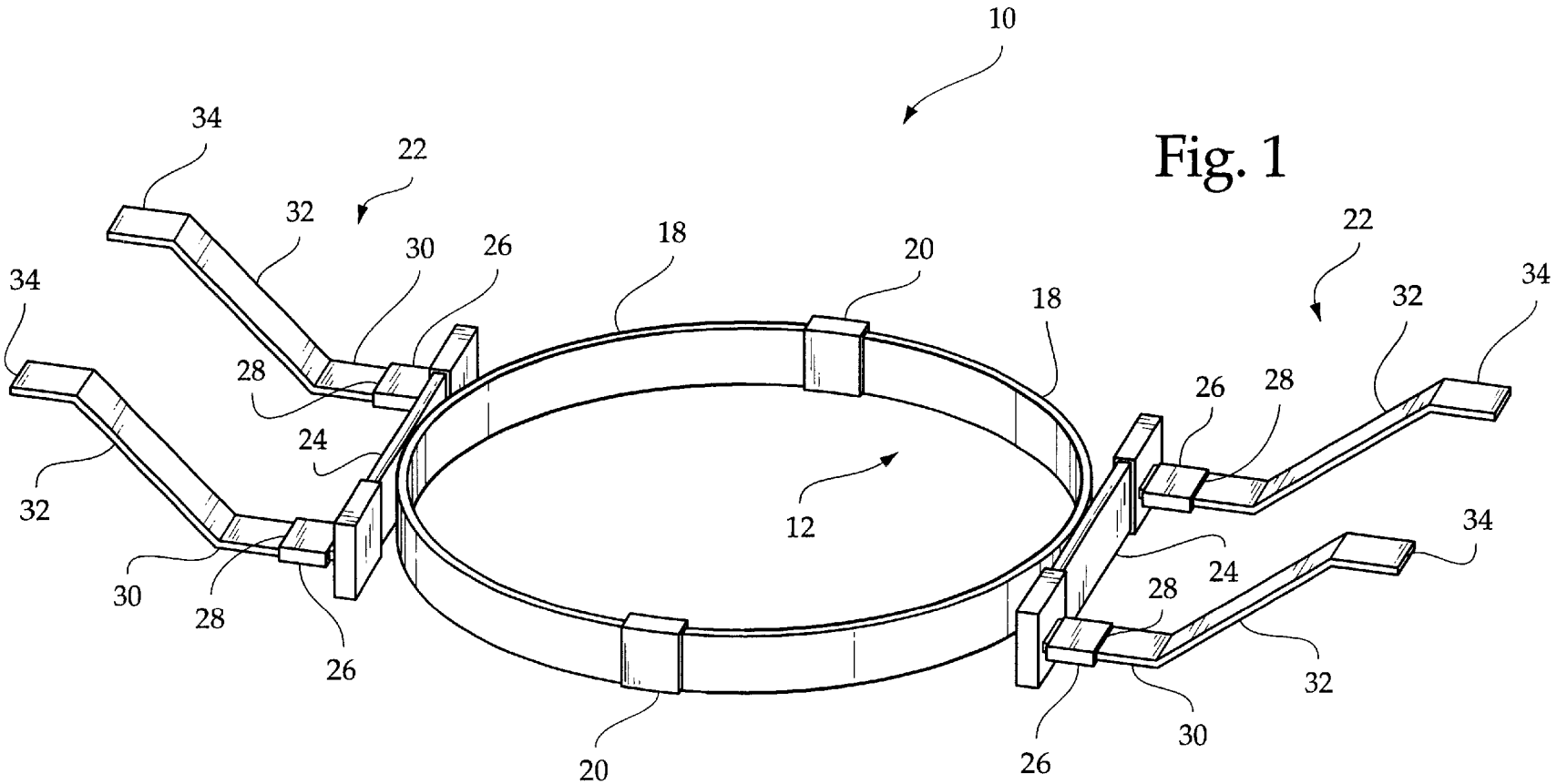
FIG. 1 is a perspective view of the preferred embodiment of the adjustable pot supporting device constructed in accordance with the principles of the present invention.
Figure 2:
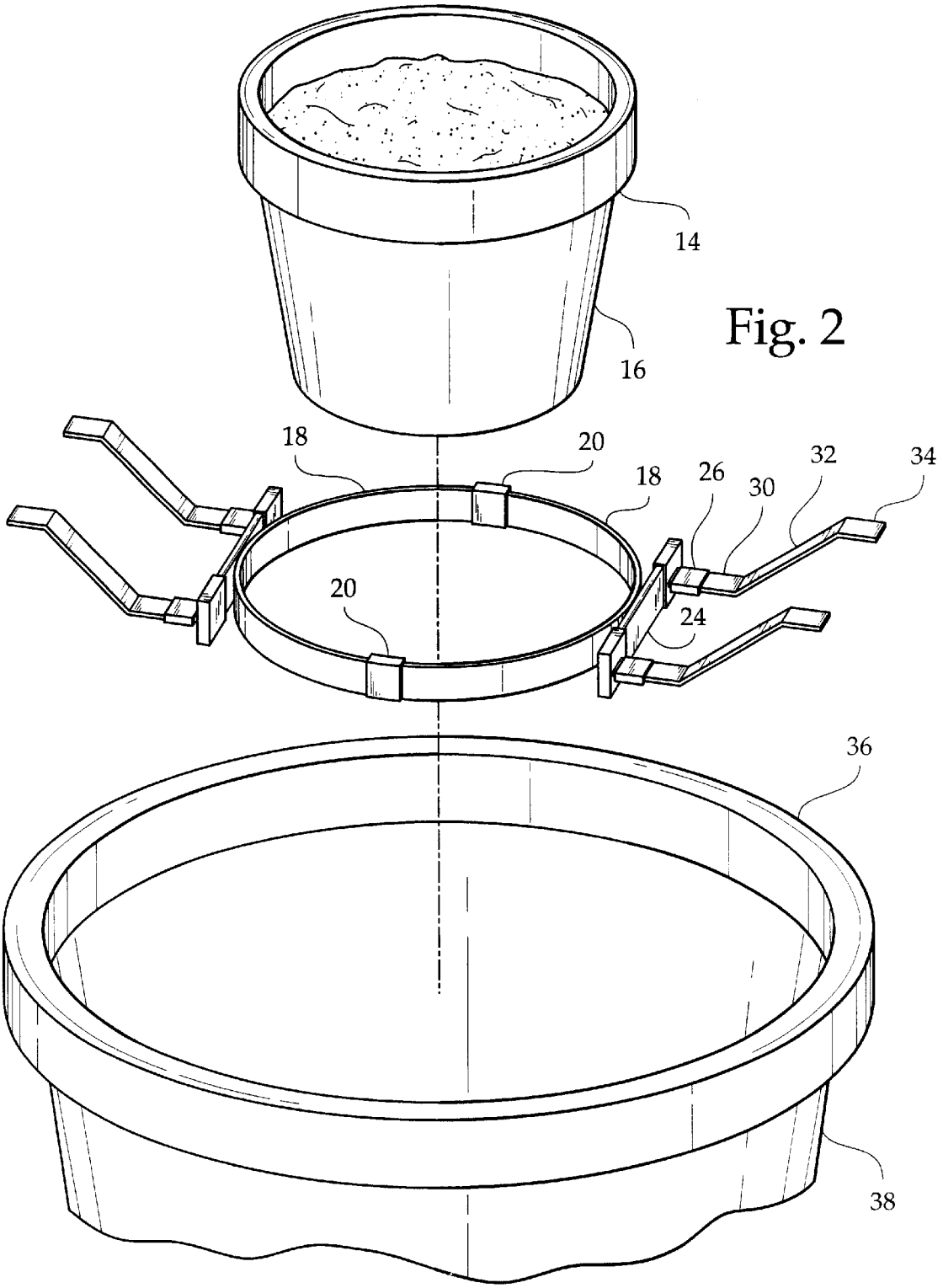
FIG. 2 is a perspective view of the present invention illustrated in use.
Figure 3:
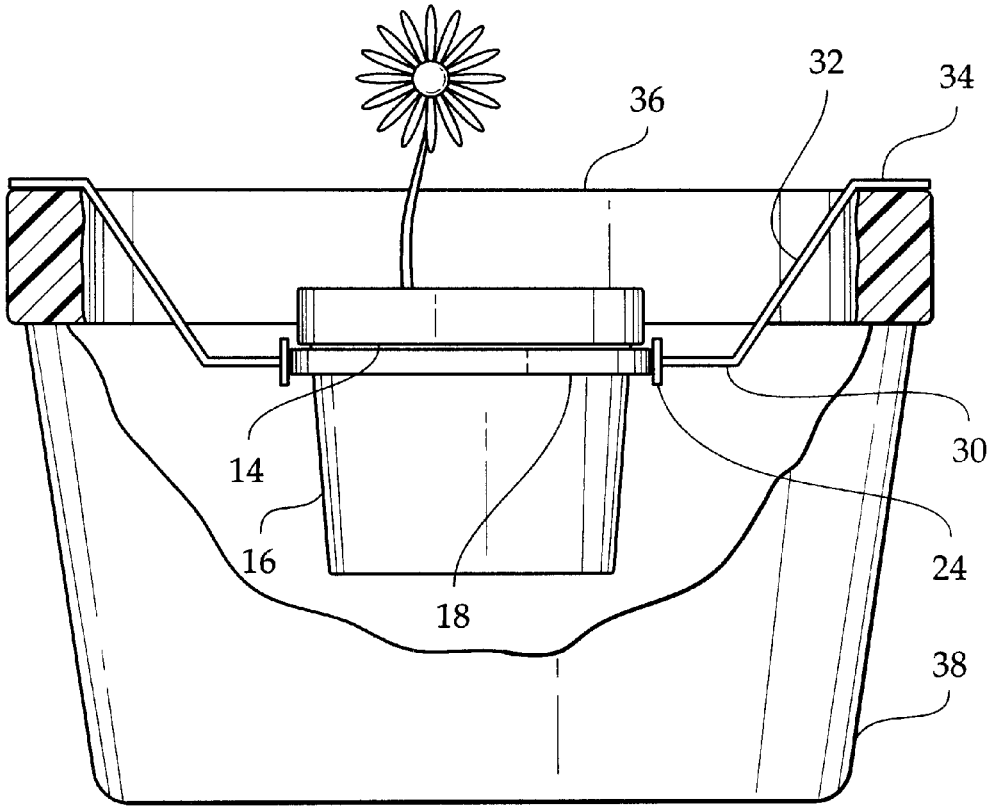
FIG. 3 is a side view of the present invention illustrated in use.

With reference now to the drawings, and in particular, to FIGS. 1 through 3 thereof, the preferred embodiment of the new and improved adjustable pot supporting device embodying the principles and concepts of the present invention and generally designated by the reference number 10 will be described.

Specifically, it will be noted in the various figures that the device relates to an adjustable pot supporting device for allowing a smaller potted plant to be supported inside a larger decorative pot. In its broadest context, the device consists of an adjustable circular band and a pair of adjustable brackets. Such components are individually configured and correlated with respect to each other so as to attain the desired objective.

The adjustable circular band 12 is adapted for being positioned below the annular ridge 14 of the small pot 16. The circular band 12 is comprised of a pair of semi-circular segments 18 each having opposed ends. The circular band 12 includes a pair of braces 20 for adjustably receiving the opposed ends of the semi-circular segments 18 to form a circle. Note FIGS. 1 and 2. The semi-circular segments 18 can be adjusted with respect to the pair of braces 20 to vary the diameter of the circle so as to accommodate the small pot 16.

The pair of adjustable brackets 22 are secured to the adjustable circular band 12. The adjustable brackets 22 are diametrically opposed with respect to one another. Each of the adjustable brackets 22 includes a base plate 24 secured to one of the semi-circular segments 18. The adjustable brackets 22 include a pair of receiving collars 26 secured to the base plate 24. The receiving collars 26 each have open outer ends 28. The adjustable brackets 22 include a pair of lower horizontal segments 30 adjustably received within the open outer ends 28 of the receiving collars 26. The adjustable brackets 22 include a pair of intermediate angularly disposed segments 32 extending outwardly from the lower horizontal segments 30. The adjustable brackets 22 include a pair of upper horizontal segments 34 extending outwardly from the intermediate angularly disposed segments 32. The upper horizontal segments 34 are positioned on the upper end 36 of the larger decorative pot 38. Note FIG. 3.

In use, the user selects the small pot 16 and the larger decorative pot 38 to be used. The adjustable circular band 12 is adjusted to fit and support the small pot 16 and the adjustable brackets 22 are then adjusted to fit the open upper end 36 of the larger decorative pot 38. The small pot 16 is then positioned within the circular band 12 and then the small pot 16 is positioned within the open upper end 36 of the larger decorative pot 38 with the upper horizontal segments 34 positioned on the upper end 36. Thus, the small pot 16 will be supported within the larger decorative pot 38 without having to repot the small potted plant contained therein.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable pot supporting device for allowing a smaller potted plant to be supported inside a larger decorative pot, wherein the smaller potted plant is disposed within a small pot having a main portion having a diameter and an upper portion having a diameter greater than the main portion whereby an annular ridge is formed between the main portion and the upper portion and wherein the larger decorative pot has an open upper end, the adjustable pot supporting device comprising:

an adjustable circular band adapted for being positioned below the annular ridge of the small pot, the circular band being comprised of a pair of semi-circular segments each having opposed ends, the circular band including a pair of braces for adjustably receiving the opposed ends of the semi-circular segments to form a circle; and a pair of adjustable brackets secured to the adjustable circular band, the adjustable brackets being diametrically opposed with respect to one another, each of the adjustable brackets including a base plate secured to one of the semi-circular segments, each of the adjustable brackets including a pair of receiving collars secured to the base plate, the receiving collars each having open outer ends, the adjustable brackets including a pair of lower horizontal segments adjustably received within the open outer ends of the receiving collars, the adjustable brackets including a pair of intermediate angularly disposed segments extending outwardly from the lower horizontal segments, the adjustable brackets including a pair of upper horizontal segments extending outwardly from the intermediate angularly disposed segments, the upper horizontal segments being positioned on the upper end of the larger decorative pot.

2. An adjustable pot supporting device for allowing a smaller potted plant to be supported inside a larger decorative pot, wherein the smaller potted plant is disposed within a small pot having a main portion having a diameter and an upper portion having a diameter greater than the main portion whereby an annular ridge is formed between the main portion and the upper portion and wherein the larger decorative pot has an open upper end, the adjustable pot supporting device comprising:

an adjustable circular band adapted for being positioned below the annular ridge of the small pot, the adjustable circular band having a pair of semi-circular segements which each have opposed ends, the adjustable circular band also having a pair of braces for adjustably receiving the opposed ends of the semi-circular segments to form a circle; and a pair of adjustable brackets secured to the adjustable circular band, the adjustable brackets diametrically opposed to each other, being positionable on the upper end of the larger decorative pot to support the small pot within the larger decorative pot, wherein each of the adjustable brackets include a base plate secured to one of the semi-circular segments, each of the adjustable brackets including a pair of receiving collars secured to the base plate, the receiving collars each having open outer ends, the adjustable brackets including a pair of lower horizontal segments adjustably received within the open outer ends of the receiving collars, the adjustable brackets including a pair of intermediate angularly disposed segments extending outwardly from the lower horizontal segments, the adjustable brackets including a pair of upper horizontal segments extending outwardly from the intermediate angularly disposed segments, the upper horizontal segments positionable on the upper end of the larger decorative pot.

3. The adjustable pot supporting device as set forth in claim 2 wherein the adjustable brackets are diametrically opposed with respect to one another.

* * * * *